United States Patent [19]

Callahan

[11] Patent Number: 4,493,860

[45] Date of Patent: Jan. 15, 1985

[54] APPLYING AN ADHESIVE STRIP TO A CONTAINER INTERIOR

[75] Inventor: Kevin M. Callahan, Rockledge, Pa.

[73] Assignee: International Paper Company, New York, N.Y.

[21] Appl. No.: 448,103

[22] Filed: Dec. 9, 1982

[51] Int. Cl.[3] ..... B05D 7/22

[52] U.S. Cl. ..... 427/230; 118/408; 156/69; 427/238; 427/239

[58] Field of Search ..... 156/69; 425/127, 113; 427/230, 238, 239; 264/267, 269; 118/408

[56] References Cited

U.S. PATENT DOCUMENTS

| | | | |
|---|---|---|---|
| 812,329 | 2/1906 | Daugherty . | |
| 1,384,048 | 7/1921 | Coates . | |
| 1,447,816 | 3/1923 | Peelle . | |
| 2,098,857 | 11/1937 | Buckingham | 91/43 |
| 2,131,319 | 9/1938 | Greenholtz et al. . | |
| 3,074,810 | 1/1963 | Timson . | |
| 3,224,411 | 12/1965 | Blaha et al. | 118/408 |
| 3,873,258 | 3/1975 | Ratliff | 425/113 |
| 3,889,628 | 6/1975 | Usab | 118/3 |
| 3,904,718 | 9/1975 | Kuehn, Jr. | 264/39 |
| 4,120,711 | 10/1978 | Gudeman | 156/69 |
| 4,140,451 | 2/1979 | Herdzina, Jr. et al. | 425/129 R |
| 4,249,479 | 2/1981 | Eddy et al. | 118/708 |
| 4,291,641 | 9/1981 | Nowak | 118/408 |
| 4,344,814 | 8/1982 | McLaren | 156/581 |

*Primary Examiner*—Robert Dawson

*Attorney, Agent, or Firm*—Richard J. Ancel

[57] ABSTRACT

A method and apparatus for coating the interior edge of an open ended container with an adhesive strip or band. An open rim of a container abuts a flat surface on an adhesive applicator head. A flowable adhesive passes radially outwardly and thence axially, between the inner container rim surface and a part of the head, to deposit a band of adhesive, such as a hot melt adhesive, on the container inner surface. The flat surface of the head functions both to position the container relative to the head and to form a seal to thus permit adhesive coating up to the edge of the open container end.

6 Claims, 7 Drawing Figures

APPLYING AN ADHESIVE STRIP TO A CONTAINER INTERIOR

BACKGROUND OF THE INVENTION

This invention relates to a method and apparatus for applying a band or strip of an adhesive, such as a hot-melt adhesive, to the inside rim or edge of a container, such as a paperboard container. Subsequent to the coating of the container rim with the adhesive, an end closure is placed on the open end of the container, the end closure being affixed to the container by means of the adhesive to thereby define a container closed at both ends.

The art is aware of a variety of methods and apparatus for coating the interior edge or rim surface of a container, such as a tubular or other annularly continuous container. Such methods and apparatus are shown, for example, in the following U.S. patents:

U.S. Pat. No. 812,329—Daugherty
U.S. Pat. No. 1,384,048—Coates
U.S. Pat. No. 1,447,816—Peelle
U.S. Pat. No. 2,098,857—Buckingham
U.S. Pat. No. 2,131,319—Greenholtz
U.S. Pat. No. 3,074,810—Timson
U.S. Pat. No. 3,873,258—Ratliff
U.S. Pat. No. 3,904,718—Kuehn
U.S. Pat. No. 4,120,711—Gudeman
U.S. Pat. No. 4,140,451—Herdzina
U.S. Pat. No. 4,249,479—Eddy
U.S. Pat. No. 4,291,641—Nowak While apparently satisfactory for the purpose intended, prior art methods and apparatus are often limited to the application of a strip of adhesive to the interior of a circular container. With the advent of containers having non-circular cross-sectional configurations, many prior art methods and apparatus are not suitable. Further, with respect to those prior methods and apparatus which are amenable or susceptible of use with non-circular cross-sectional containers, one or more disadvantages are displayed. For example, in the noted Buckingham patent, an adhesive applicator head, having a chamber therein for distributing a flowable adhesive radially outwardly to thereby be coated on the interior of a container edge or rim, lacks a simple means to position the container rim relative to the adhesive applicator head. Further, the Buckingham apparatus and method lacks the capability of insuring that a competely continuous annular band or strip of adhesive will be applied, and that the applied adhesive will extend from the edge of the container to a desired axial extent along the container interior without dripping or other non-uniform application of the adhesive.

SUMMARY OF THE INVENTION

According to the practice of this invention, a method and apparatus for applying a strip or band of adhesive to the interior rim or edge of a container, of arbitrary cross-sectional shape, is carried out by forming an abutment surface on the applicator head, this abutment surface being contacted and abutted by the open rim end of a container which is to be provided with such a strip or coating. This abutment forms a seal and insures that an annularly continuous band of adhesive may be applied.

Further according to the practice of this invention, the applicator head is provided with a vent which establishes an air passageway between the interior of the container being coated and ambient. By virtue of this air communication, two coating modes may be employed. In the first mode, the air passageway functions to relieve vacuum within the interior of the container, after the application of the adhesive coating, which arises when the container and adhesive applicator head are moved away from each other. In the second mode, the air passageway permits the application of an above-atmospheric pressure to the interior of the container in those instances wherein it is desired to assist in the control of the application of the adhesive band.

Further in accordance with the practice of this invention, an annular chamber, termed a shim chamber, having both radially and axially extending portions, is defined by the configuration of the applicator head of this invention. This annular shim chamber permits the formation of an annularly continuous band of adhesive in an axial direction on the interior of the container.

Further, in accordance with the practice of this invention, the applicator head is provided with a detachable pattern plate whereby a variety of pattern plates having different patterns of adhesive orifices may be employed with the same overall apparatus, for the purpose of applying the adhesive band to containers having different cross-sectional configurations.

Further in accordance with the practice of this invention, those portions of the applicator head termed the extrusion plate and the shim are also detachable, also for the purpose of permitting the application of an adhesive band to containers having different cross-sectional configurations.

The full nature of the invention will be understood from the accompanying drawings and the following description and claims. It should be understood, however, that references in the following description to right and left are for convenience of description, and such terms are not intended to be used in a limiting sense.

DETAILED DESCRIPTION OF THE INVENTION

Figure 1:
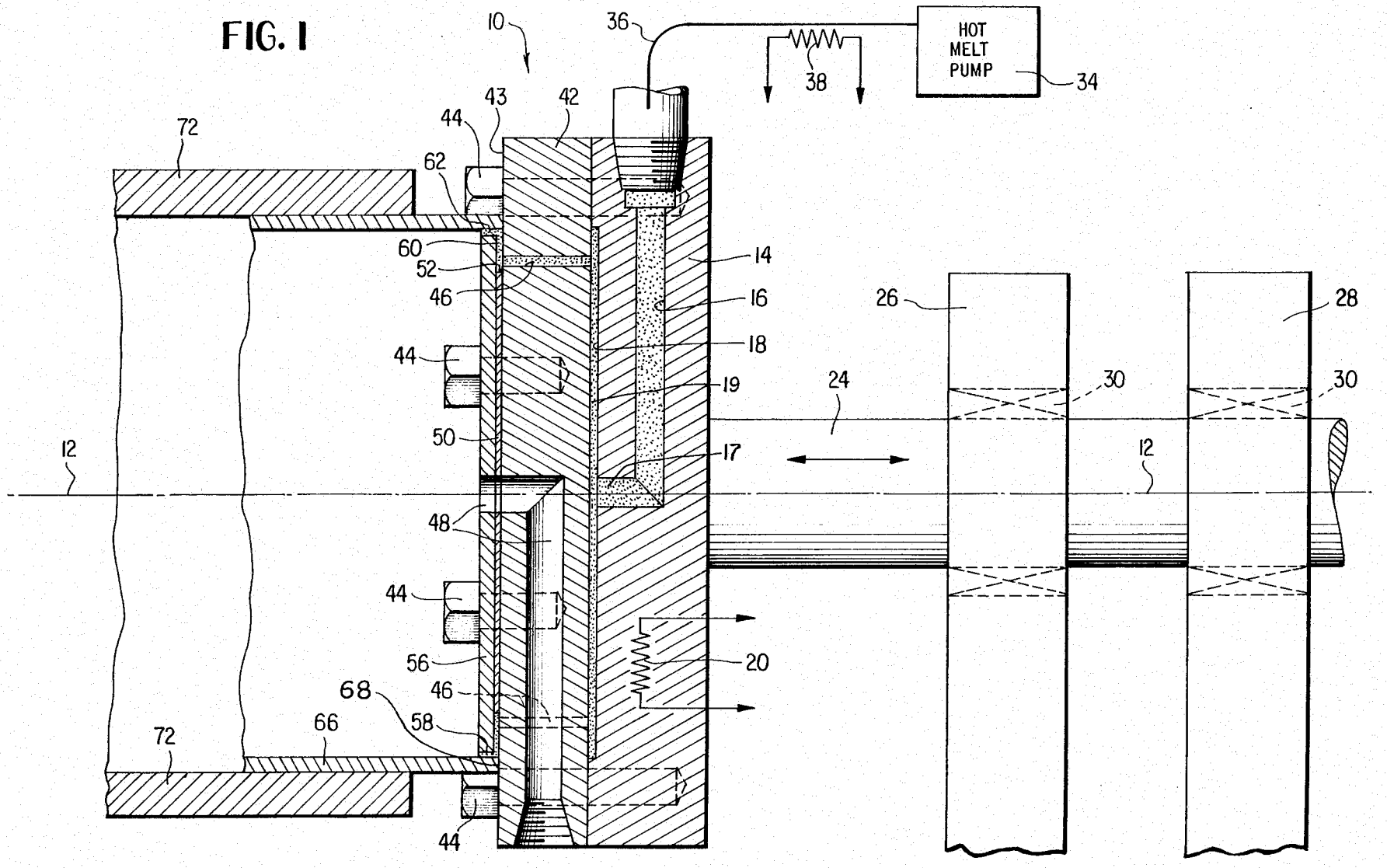
FIG. 1 is a longitudinal elevational view, partially in cross-section and partially schematic, showing the applicator head of this invention.

Referring now to FIG. 1 of the drawings, the numeral 10 denotes generally the applicator head of this invention, the applicator head being shown in conjunction with both an imaginary axis 12 which will be useful in describing the orientation of the assembly, and with a container whose interior rim portion is to be coated by the applicator head. The applicator head includes a heated plate 14 such as of aluminum having an input channel 16 for receiving a flowable adhesive, as for example a hot melt adhesive. The numeral 18 denotes a recess or cavity in one surface of plate 14 connected to channel 16 by short channel 17. The numeral 19 denotes a chamber for the flowable adhesive. Plate 14 is heated by an electrical resistance cartridge heater schematically denoted by the numeral 20. The numeral 24 denotes a shaft connected to and carrying plate 14, the shaft mounted for reciprocating motion as indicated by the double-headed arrow parallel to axis 12. The numerals 26 and 28 denote supports for the shaft 24, the shaft 24 sliding in bearings denoted by the numeral 30. Shaft 24 may be reciprocated by cams, hydraulic motors, or the like by mechanisms well known in the art.

The numeral 34 schematically denotes a hot-melt pump, such as an LTI piston pump whose discharge is fed through flexible hose 36 and is coupled to inlet channel or passageway 16 of plate 14. Hose 36 is heated by an electrical resistance heater therein schematically designated by the numeral 38.

The numeral 42 denotes a pattern plate in the general form of a rectangular parallelepiped having a flat abutment surface 43, the pattern plate being secured by bolts or other fasteners 44 to plate 14.

The numeral 46 denotes any one of a plurality of exit orifices passing through plate 42 and establishing communication between flowable adhesive chamber 19 and flat abutment surface 43. Exit orifices 46 are formed so that their outline on surface 43 is both congruent to and radially inwardly of the container cross-section, as referred to axis 12.

The numeral 50 denotes a shim having an axially extending edge 52 of continuous annular extent. The numeral 56 denotes an extrusion plate having an annularly continuous, axially extending edge 58. Edges 58 and 52 are also congruent to the cross-sectional outline of container 66. If the container cross-section is not uniform throughout, the congruency must be with respect to that of rim 68. Extrusion plate 56 and shim 50 are secured to plate 42 by means of fasteners, also indicated by the numeral 44. The right hand face of extrusion plate 56 and flat abutment surface 43, in combination with axially extending edge 52 of shim 50, defines a radially extending portion 60 of an annular cavity. The annular cavity also includes an axially extending portion 62 defined by extrusion plate edge 58 and the interior surface of a container 66 which is to be coated. The right rim 68 of container 66 abuts surface 43. The container is closed at its left end (not illustrated) by any conventional closure, and is supported in a fixture or holder denoted by 72.

Figure 2:
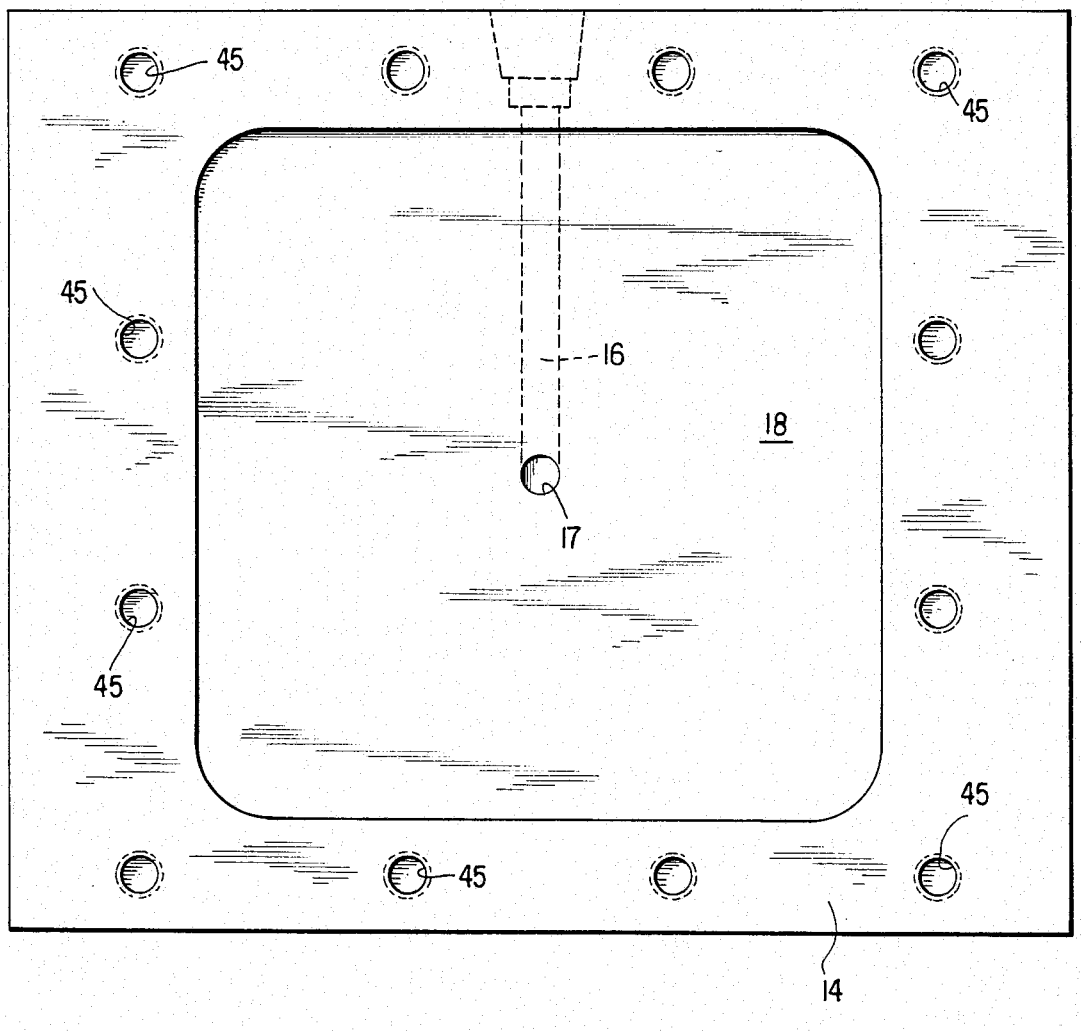
FIG. 2 is a plan view showing the heated plate of the applicator head of this invention.

Referring now to FIG. 2 of the drawings, a plan view of heated plate 14 is illustrated. The recess 18 is in the form of a shallow and generally rectangular cavity in the left (FIG. 1) surface of the plate, the plate carrying a plurality of apertures 45 for the reception of fasteners 44 such as bolts. Passageway 16 is shown in dashed lines, with one end communicating with axially extending short channel 17. One end of heated flexible hose 36 is also indicated in dashed lines as communicating with one end of passageway 16.

Figure 3:
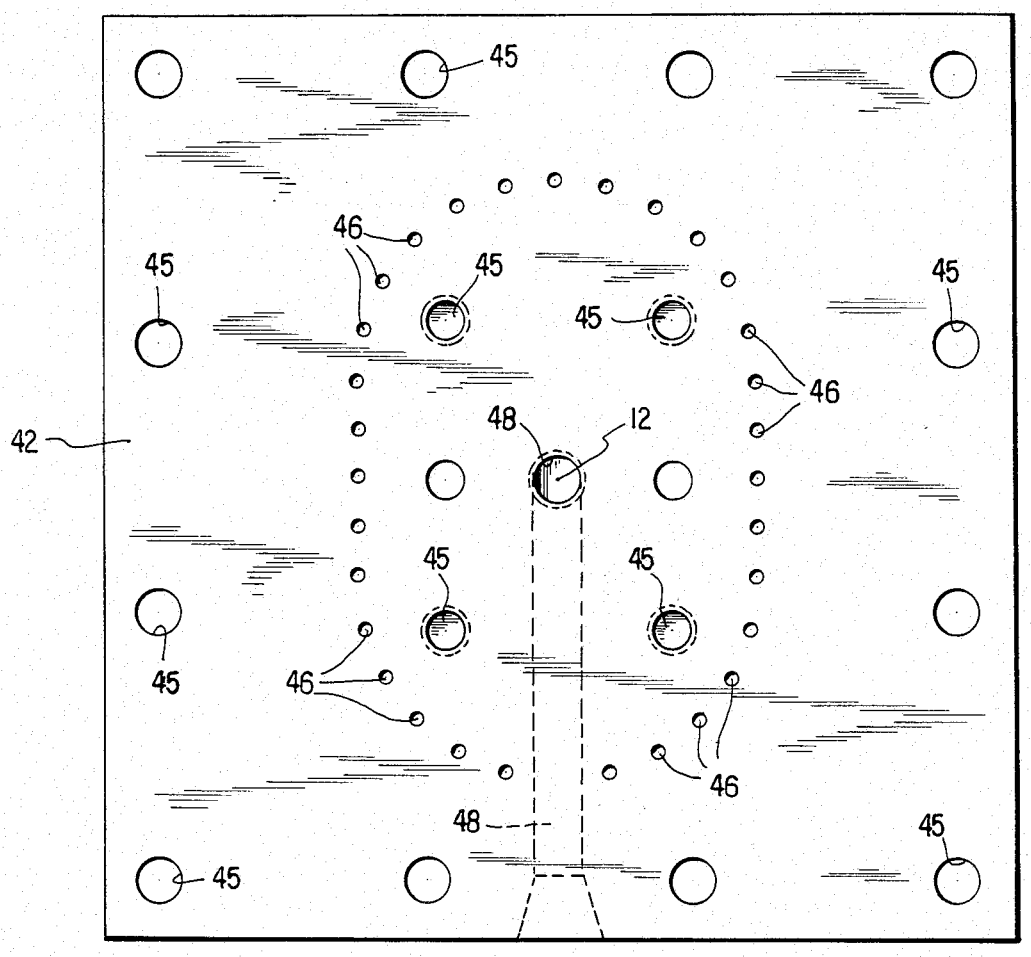
FIG. 3 is a plan view showing the pattern plate of the applicator head of this invention.

Referring now to FIG. 3 of the drawings, a plan view is illustrated of pattern plate 42, the pattern plate also being formed as for example of aluminum and having a plurality of apertures 45 for receiving fasteners 44. The configuration or pattern of exit openings 46 is shown at FIG. 3 to be generally eliptical, to thereby conform or correspond with a container 56 of eliptical cross-section. The reader will understand that in the event that a container 66 is of circular cross-section, the the pattern or configuration of openings 46 at surface 43 would be circular, that if the container 66 were of rectangular cross-section, then the pattern or configuration of openings 46 would be rectangular. In general, the configuration of openings 46 will correspond to the cross-sectional shape of container 66. As shown at FIG. 3, a portion of air vent passageway 48 extends through abutment surface 43.

Figure 4:
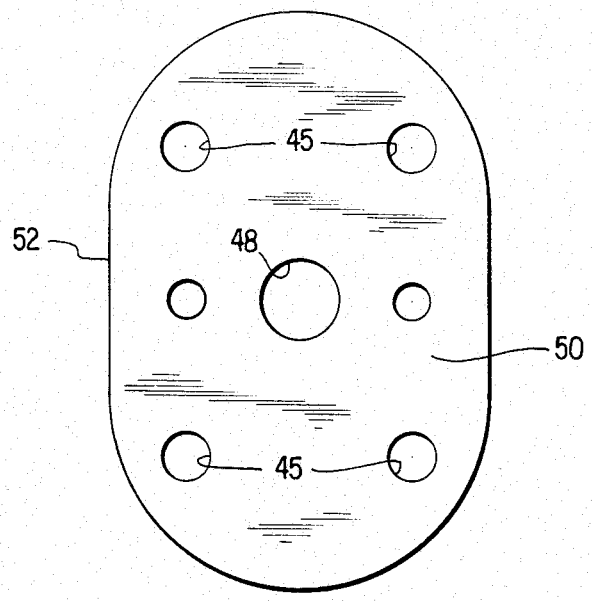
FIG. 4 is a plan view showing the shim of the applicator head of this invention.

Referring now to FIG. 4 of the drawings, a plan view of the shim 50 is illustrated, the shim having a plurality of openings 45 for the reception of the fasteners 44 and a central opening for air passageway 48.

Figure 5:
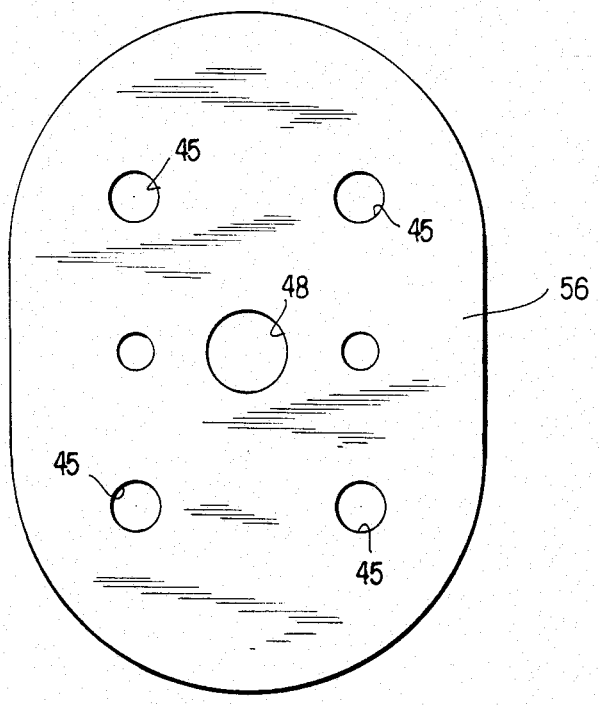
FIG. 5 is a plan view of the extrusion plate of the applicator of this invention.

Referring now to FIG. 5 of the drawings, the extrusion plate 56 is illustrated, this plate also having a plurality of openings 45 for the reception of the fasteners 44 and a central opening for air passageway 48. The reader will immediately comprehend that the openings 45 in extrusion plate 56, shim 50 and pattern plate 42 are aligned, as are aligned openings 45 in pattern plate 42 and plate 14.

In general the outlines of edge 58, edge 52 and exit orifices 46 conform to the cross-sectional shape of container 66 and to the radial outline of the exit orifices. Edge 58 extends radially outwardly of exit orifices 46, which edge 52 is either radially inwardly thereof or at about the same radius, all referred to axis 12.

The mode of operation of the device is as follows. Assuming the fixture 72 to be stationary, a container 66, closed at its left (not illustrated) end is placed in the fixture. Shaft 24 is moved from the right to the left until it assumes the position shown at FIG. 1. In this position, the rim 68 of container 66 abuts flat abutment surface 43 thereby forming a seal therewith. Hot melt pulp 34 is actuated to force flowable adhesive through exit orifices 46 and into radially extending portion 60 of the shim chamber. Adhesive continues to flow radially outwardly until it strikes the inner surface of container 66. Adhesive flow continues, now flowing in a generally axial direction in portion 62 of the annular shim chamber. In the case of a hot melt adhesive, the temperature of container 66 is usually at ambient and accordingly the adhesive immediately adheres to the inside surface of container 66, forming a band or strip adjacent the open edge thereof. Shaft 24 is now moved from left to right, thereby moving head 10 away from fixture 72 and container 66. The increase in volume of air within the container 66 would ordinarily cause a vacuum therein, however, such vacuum is precluded by means of air passageway 48. The motion of head 10 to the right continues until the extrusion plate 56 is free from rim 68 of container 66. Container 66 is then indexed from the applicator, a new container is placed in the fixture, and the cycle is repeated. The reader will observe that the adhesive will not flow radially outwardly beyond rim 68.

The container 66, with the hot melt adhesive applied, is indexed to another position away from the hot melt applicator. Then, a plastic ring 88 is applied to the package having the hot melt adhesive applied thereon. Next, container 66 is discharged and is filled with a product such as a foodstuff and a closure such as foil 90 is applied to close the container.

In practice, the fixture 72 may be one portion of a rotary turret. Further, the fixture 72 may reciprocate along axis 12 instead of head 10 so reciprocating, or alternatively, both the fixture 72 and the lead 10 may move away from each other, either on a straight axis 12, or along different rotary axes of revolution.

The paperboard container 66 may be fashioned by known techniques at the same facility where packaging of the containers 66 takes place. In one mode of packaging, the paperboard containers 66 are formed form flat paperboard blanks, and are thereafter placed on the apparatus of this invention wherein their edges may be lined with the adhesive, as described above. Thus, the invention contemplates the use of the apparatus described in conjunction with (if desired) other apparatus, known in this art, which forms the paperboard containers 66 from blanks. The formed containers are then placed into the apparatus of this invention wherein the adhesive is applied.

Figure 6:
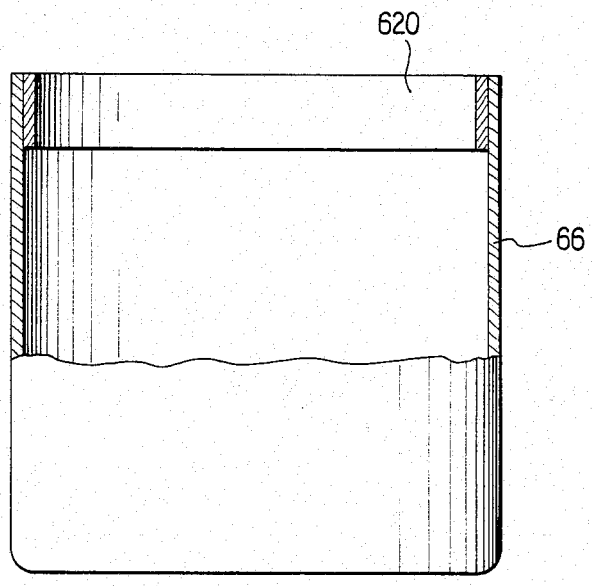
FIG. 6 is a partial cross-sectional view of the paperboard container shown at FIG. 1 subsequent to the application of the hot melt adhesive and its ejection from the apparatus.
Figure 7:
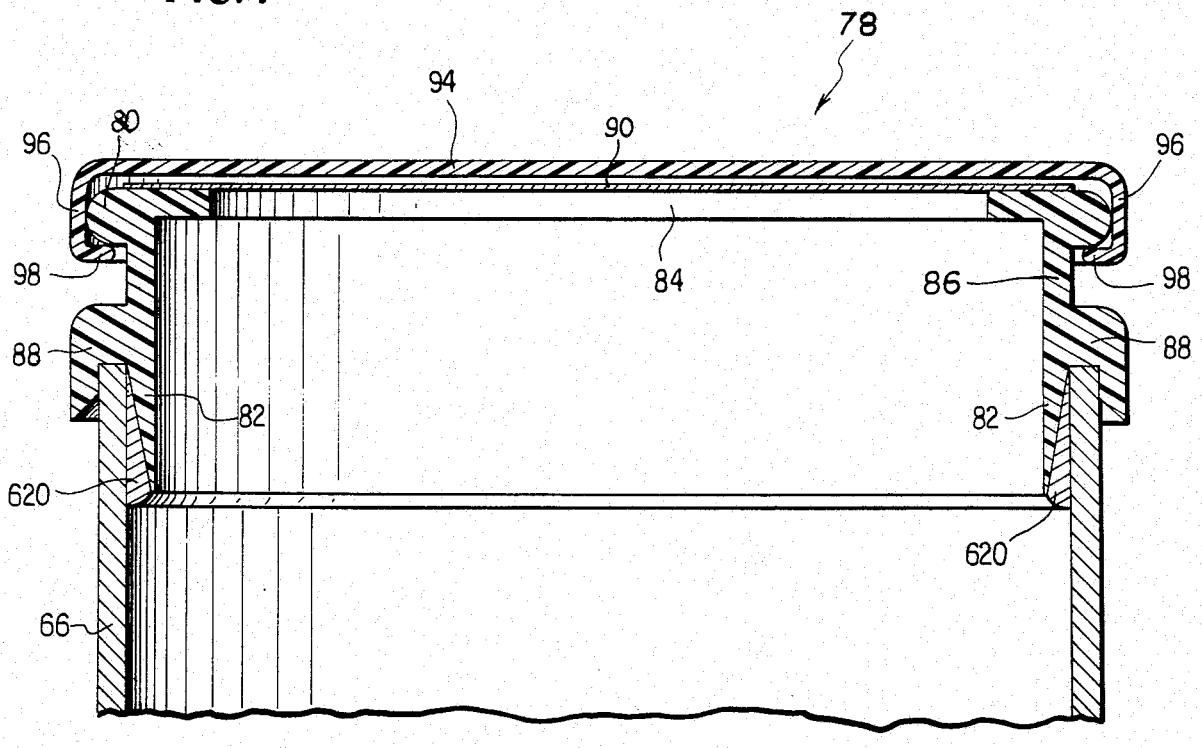
FIG. 7 is a cross-sectional view of the upper portion of the container of FIG. 6 subsequent to its final closure by a cap assembly.

Referring now to FIG. 6 of the drawings, the completed container 66 just after its removal from the apparatus of FIG. 1 is illustrated, the container including an adhesive ring denoted by the numeral 620 on the interior surface adjacent its upper rim. This ring is formed in axially extending cavity portion 62, as shown at FIG. 1. The container is illustrated as closed at the bottom, although it will be understood that the bottom closure, may be completed at various stages in filling the container. The ring or band of the hot melt adhesive 620 is somewhat warm and is tacky. At this stage, a cap assembly, such as indicated at FIG. 7, may be applied subsequent to, for example, filling the container with a food product such as corn chips, cereal, hot cocoa mix or the like. In FIG. 7, the numeral 78 denotes generally a top cap or top closure assembly for the container 66 of FIG. 6 provided with the annular ring 620 of hot melt adhesive by the apparatus of FIG. 1. The closure includes an end ring formed of a plastics material, such as polyethylene or polypropylene, the end ring including an upper, annularly continuous bead 80 and a lower and axially extending depending skirt 82 which is tapered. A central aperture is formed in the uppermost portion of the end ring, the sides of the aperture being denoted by the numeral 84. The numeral 86 denotes an intermediate portion of the end ring, with lower outermost annularly continuous portion 88 also depending therefrom. An annularly continuous groove, between depending skirt portion 82 and portion 88, receives the upper rim of container 66. In applying the end ring to the container 66, it will be observed that the ring 620 of hot melt adhesive has been distorted somewhat, as shown at FIG. 7. The numeral 90 denotes a foil, such as aluminum foil, which is placed over the opening in the end ring, the foil 90 being secured to the outer periphery of the aperture, adjacent rim 84, as by suitable adhesive. The purpose of foil 90 is to protect the contents of the container from the entry of contaminants and also to maintain any predetermined moisture content of the foodstuff therein. Its configuration is congruent to the configuration of the opening in the end wall member.

The numeral 94 denotes an outermost snap cap also formed of a plastics material, the cap including an annularly continuous depending skirt 96 which terminates in a radially inwardly extending portion 98. Portion 98 snaps underneath bead 80 of the end wall member. In practice, the lower surface of snap cap 94 is in contact with foil member 90, but is shown as being spaced therefrom for purposes of illustration. After the snap cap is initially removed and foil 90 ruptured to gain access to the foodstuff, it is replaced by snapping over head 80.

The end ring is congruent to the cross-sectional shape of container 66, the latter being of either circular or non-circular such as rectangular or oval. It will be understood that the specific top closure assembly 78 illustrated is merely exemplary. For example, the end ring may include a screw plug, a hinged flap, a friction plug, or it may be completely closed at the top for these packaging uses wherein multiple access to the container interior is not contemplated.

The containers 66 described herein generally comprise a body portion or wall made from a five-layer construction consisting of (from the outside in): polyethylene (P.E.)/paperboard (solid bleached sulfate)/-P.E./foil/P.E. Other laminate constructions can be utilized if necessary. For example, another such construction consists of P.E./paperboard/P.E./P.E. The P.E. may vary in thickness from 0.5 to 1.5 mil, and it may comprise either low or high density P.E., or combinations thereof. Moreover, other plastics such as Surlyn, polypropylene, and the like may be substituted for, or used in conjunction with, P.E., depending upon the final barrier properties required. The paperboard layer may vary in thickness between 12 and 25 mils, and the aluminum foil is generally 0.00035 inches thick. It will be obvious that a laminate construction can be designed to meet varying barrier requirements. It will also be recognized that the containers may be manuactured in various shapes, i.e., round, oval, oblong, or "rectangular" with rounded corners. Since the body of the containers 66 may be manufactured from a blank, no extra labeling is required since the blanks can be pre-printed.

While the invention is not limited to a specific hot melt adhesive, hot melt adhesive, marketed under the trademark Instant Lok by National Starch and Chemical Corporation of Bridgewater, N.J. affords a specific example of a suitable hot melt adhesive.

Generally speaking, the present invention is directed to a hot melt adhesive applicator for applying a hot melt adhesive to the interior rim or edge portion of an open ended container. The applicator includes a head which has a flat abutment surface on one portion thereof for abutment by the container rim. The flat abutment surface is normal to an imaginary axis and the head has a chamber therein for distributing a flowable adhesive to a plurality of annularly spaced, adhesive exit orifices on the abutment surface. A shim is on the abutment surface, and the shim edge is positioned radially inwardly of the exit orifices. An extrusion plate is positioned on the shim, and the edge of the extrusion plate is located radially outwardly of the exit orifices. The edge of the extrusion plate extends axially, at right angles to the flat abutment surface, to thereby define an adhesive band forming surface. An annular shim chamber has a radially extending portion defined by (1) the edge of the shim and (2) the space between the flat abutment surfaces of the head and the extrusion plate. An axially extending portion of the shim chamber is defined by an interior surface portion of the container and the edge of the extrusion plate, whereby when the end of a container of size larger than the radial extent of the extrusion plate edge is placed against the flat abutment surface, a flowable adhesive passes through the exit openings and into the shim chamber and thence radially outwardly and thence in an axial direction between the extrusion plate edge and the interior edge of the container, to thereby form an adhesive band on the inside edge of the container.

Although the invention has been described above by reference to preferred embodiments, it will be appreciated that other constructions may be devised, which are, nevertheless, within the scope and spirit of the invention and are defined by the claims appended hereto.

What is claimed is:

1. A hot melt adhesive applicator for applying a hot melt adhesive to the interior rim or edge portion of an open ended container of arbitrary cross-sectional shape, the applicator including a head, the head including a flat abutment surface on one portion thereof for abutment by the container rim, the flat abutment surface being normal to an imaginary axis, the head having a chamber therein for distributing a flowable adhesive to a plurality of annularly spaced, adhesive exit orifices on said abutment surface, a pattern plate, the pattern plate having said exit orifices therein an annularly continuous pattern and having one surface which is said flat abutment surface, a shim on said abutment surface, the shim edge positioned radially inwardly of said exit orifices, an extrusion plate positioned on said shim, the edge of the extrusion plate being located radially outwardly of said exit orifices, the edge of the extrusion plate extending axially, at right angles to the flat abutment surface, to thereby define an adhesive band forming surface, an annular shim chamber having a radially extending portion defined by (1) the edge of the shim and (2) the space between the flat abutment surface of the head and the extrusion plate, an axially extending portion of said shim chamber defined by an interior surface protion of the container and the edge of the extrusion plate, an air vent passage extending through the extrusion plate, the shim, and a part of the remainder of the head, whereby the interior of a container having its rim abutted against the flat abutment surface can be vented to ambient or can be pressurized during the application of adhesive to the container, whereby when the open end of a container of size larger than the radial extent of the extrusion plate edge is placed against the flat abutment surface, a flowable adhesive passes through the exit orifices and into the shim chamber and thence radially outwardly and thence in an axial direction between the extrusion plate edge and the interior edge of the container, to thereby form an annularly continuous adhesive band on the inside edge of the container.

2. The applicator of claim 1 wherein the pattern plate is separable and removable from the head, whereby different pattern plates having different patterns of adhesive exit orifices may be employed with the same head, to thereby permit the head to apply a band of adhesive to containers of different cross-sectional configuration.

3. The applicator of claim 1 wherein the head is mounted to reciprocate in a direction parallel to said imaginary axis, to thereby move toward and away from a container.

4. The applicator of claim 1 wherein the edge of the shim and the edge of the extrusion plate both conform to the radial outline of the exit orifices.

5. A method of affixing an annularly continuous strip of adhesive to the interior rim or edge of an open ended container, the method including the steps of placing the rim of the open end of the container against a flat abutment surface, moving a mass of an adhesive radially outwardly along an annularly continuous channel until the adhesive strikes the interior surface of the container adjacent said edge, causing the adhesive to then flow in a generally axial direction along a portion of the interior surface of the container, whereby an annularly continuous strip or band of adhesive of uniform radial thickness is formed on the container wall interior.

6. The method of claim 5 including the step of pressurizing the interior of the container to a pressure above ambient during the radial and axial flow of the adhesive.

* * * * *